US011834299B2

(12) United States Patent
Wagenleitner

(10) Patent No.: US 11,834,299 B2
(45) Date of Patent: Dec. 5, 2023

(54) ESCALATOR OR MOVING WALKWAY HAVING AN ILLUMINATING DEVICE FOR ILLUMINATING A TRANSITION REGION

(71) Applicant: INVENTIO AG, Hergiswil (CH)

(72) Inventor: Georg Wagenleitner, Roßleithen (AT)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 17/913,280

(22) PCT Filed: Mar. 15, 2021

(86) PCT No.: PCT/EP2021/056458
§ 371 (c)(1),
(2) Date: Sep. 21, 2022

(87) PCT Pub. No.: WO2021/190965
PCT Pub. Date: Sep. 30, 2021

(65) Prior Publication Data

US 2023/0112276 A1 Apr. 13, 2023

(30) Foreign Application Priority Data

Mar. 25, 2020 (EP) ..... 20165630

(51) Int. Cl.
*B66B 23/22* (2006.01)

(52) U.S. Cl.
CPC ..... *B66B 23/225* (2013.01)

(58) Field of Classification Search
CPC ..... B66B 23/225; B66B 27/00
See application file for complete search history.

(56) References Cited

U.S. PATENT DOCUMENTS 10,479,653 B2 * 11/2019 Li ..... B66B 29/005
2005/0088520 A1 * 4/2005 Wiesinger ..... B66B 29/005 348/42

(Continued)

FOREIGN PATENT DOCUMENTS

CN 203533349 U 4/2014
CN 209127856 U 7/2019

(Continued)

OTHER PUBLICATIONS

"Lighting—ThyssenKrupp Elevator (ES/PBB)," Sep. 8, 2013, Retrieved from the Internet: URL:http://web.archive.org/web/20130908194219/http://www.thyssenkrupp.si/fileadmin/user_upload/images/0svetlitev_izvedbe_tekoce_stopnice_en.pdf Retrieved on Sep. 19, 2014, XP055141659.

(Continued)

*Primary Examiner* — Evan P Dzierzynski
(74) *Attorney, Agent, or Firm* — Knobbe Martens Olson & Bear LLP

(57) ABSTRACT

The disclosure relates to a passenger transport system in the form of an escalator or a moving walkway. The system can include a stationary access region, a transport belt made up of a plurality of tread units, a transition region in which combing structures of the transport belt adjoin static comb structures of the access region, and an illuminating device having at least one light source for emitting light in the visible spectrum. The illuminating device can be configured such that at least a first portion of the light emitted is focused to predominantly illuminate an elongate transition surface which includes the transition region.

16 Claims, 3 Drawing Sheets

(56) References Cited

U.S. PATENT DOCUMENTS

| | | | | |
|---|---|---|---|---|
| 2013/0163233 | A1* | 6/2013 | Niedermayer | B66B 23/225 362/146 |
| 2014/0076686 | A1* | 3/2014 | De Coi | B66B 25/00 198/322 |
| 2017/0043982 | A1* | 2/2017 | Wang | G01V 8/12 |

FOREIGN PATENT DOCUMENTS

| | | | |
|---|---|---|---|
| JP | S5241885 | U | 3/1977 |
| JP | H0475995 | A | 3/1992 |
| JP | 2000128469 | A | 5/2000 |
| JP | 2015182878 | A | 10/2015 |
| WO | WO 2020021699 | A1 | 1/2020 |

OTHER PUBLICATIONS

International Search Report for International Application No. PCT/EP2021/056458 dated Jun. 18, 2021.

* cited by examiner

ESCALATOR OR MOVING WALKWAY HAVING AN ILLUMINATING DEVICE FOR ILLUMINATING A TRANSITION REGION

TECHNICAL FIELD

The present disclosure relates to a passenger transport system in the form of an escalator or a moving walkway.

SUMMARY

Escalators and moving walkways are installed in buildings to transport people along inclined or horizontal transport paths. For this purpose, they have, among other things, various components that are firmly connected to the building and are thus stationary. These include, for example, a stationary access region at an entrance end and at an exit end of the passenger transport system. Furthermore, the passenger transport system has displaceable components, e.g., components which can be moved relative to the stationary components. These include, for example, a transport belt on which passengers stand and with which the passengers can then be transported along the transport path from the access region at the entrance end to the access region at the exit end.

Static comb structures are typically provided on the access region at a transition region where the transport belt that can be displaced in a circumferential manner adjoins components of the stationary access region. These comb structures can be designed, for example, in the form of a comb plate on which a plurality of teeth protrude at regular intervals and thereby form the comb structure. On an upper side of the transport belt, combing structures made up of projections and grooves are generally provided, which are designed to be substantially complementary to the comb structures. When the transport belt moves relative to the stationary access region or the stationary comb plate provided there, the combing structures of the transport belt adjoin the static comb structures of this access region in the transition region or engage in them locally.

When entering or leaving the passenger transport system, passengers should be able to recognize a transition between the particular stationary access region and the moving transport belt in order to prevent the passenger from stumbling when initially entering the transport belt or when later exiting the transport belt. For this purpose, lamps are typically provided on conventional escalators and moving walkways, which lamps in particular illuminate part of the stationary access region and adjoining parts of the transport belt. For example, CN 203533349 U describes an integrated comb plate lamp. The documents JP S52 41885 U, XP055141659, CN 209 127 856 U, and JP 2000 128469 A disclose comb plate illuminating means of the aforementioned type.

Among other things, there may be a need for a passenger transport system in which a transition between the stationary access region and the displaceable transport belt for passengers is more clearly recognizable.

A requirement of this kind can be met by a passenger transport system according to the independent claim. Advantageous embodiments are defined in the dependent claims and in the following description.

According to one aspect of the disclosure, a passenger transport system is proposed in the form of an escalator or a moving walkway, which has a stationary access region, a transport belt, a transition region, and an illuminating device. The transport belt has a plurality of tread units arranged one behind the other along a direction of motion and can be displaced in a circumferential manner relative to the access region. In the transition region, combing structures of the displaceable transport belt adjoin static comb structures of the access region. The illuminating device has at least one light source for emitting light in the visible spectrum. The illuminating device is configured in such a way that at least a first portion of the light emitted by the at least one light source is focused in such a way that it predominantly illuminates an elongate transition surface which includes the transition region including the comb structures and the structures of the transport belt which mesh therewith in the region of the combing structures, the transition surface extending transversely to a direction of longitudinal extension of the passenger transport system along an entire exposed width of the transport belt.

Possible features and advantages of embodiments of the disclosure can be considered, inter alia and without limiting the disclosure, to be based upon the concepts and findings described below.

As already indicated in the introduction, conventional escalators and moving walkways are usually provided with illuminating means which illuminate the entire access region and at least parts of the transport belt. In this case, all partial regions of the passenger transport system at their entrance and exit regions, along which a passenger can move, are illuminated substantially uniformly and non-specifically.

With careful observation, in this conventionally illuminated passenger transport system, the passenger can see, for example, when entering the passenger transport system, where the stationary access region ends and where the moving transport belt begins or, when exiting the passenger transport system, where the moving transport belt ends and where the stationary access region begins. However, recognizing the transition between the stationary access region and the transport belt requires the passenger's attention.

It has been recognized that it is possible to actively contribute to drawing the passenger's attention to said transition by specifically illuminating a specific transition surface that includes this transition so as to make said transition visually recognizable to the passenger.

In order to achieve this, equipping the passenger transport system with a special illuminating device is proposed. In contrast to conventional illuminating devices in passenger transport systems which have evenly illuminated large partial regions of the access region and the transport belt, this illuminating device is intended to be specially configured to predominantly illuminate a specifically defined transition surface with the light it generates.

The transition surface comprises the transition region where the combing structures of the displaceable transport belt adjoin the static comb structures of the stationary access region. The transition region thus substantially corresponds to the region or the edge that a passenger has to cross in order to get from the stationary access region to the transport belt, or vice versa.

The transition surface should be elongate, e.g., the length thereof should be greater than the width thereof. The length of the transition surface is to be measured in a direction that corresponds to the direction in which the width of the passenger transport system is measured, e.g., in a direction transverse to the direction of longitudinal extension of the passenger transport system.

The length of the transition surface should be dimensioned in such a way that the transition surface extends transversely to the direction of longitudinal extension of the passenger transport system substantially along the entire exposed width of the transport belt. The exposed width of the transport belt relates to the partial region of the transport belt that is exposed to the outside and can thus be stepped on by a passenger. Typically, this exposed width of the transport belt corresponds to a distance between balustrades or bases of balustrades which delimit the transport belt on both sides and possibly cover partial regions of the transport belt, and therefore these partial regions are not to be added to the exposed width of the transport belt.

In order to further increase the passenger's attention, the illuminating device according to the disclosure has a projection device. In this case, the projection device is configured to project a second portion of the light emitted by the at least one light source onto a projection surface in such a way that at least one symbol selected from a plurality of possible symbols is selectively displayed.

In this case, the light emitted by the light source in the illuminating device is divided into at least two portions. While the first portion is focused onto the elongate transition surface as described above, the second portion of the light is projected onto a projection surface in such a way that at least one symbol is displayed therewith.

A symbol can have many different characteristics. For example, a symbol can be a simple line, surface, or contour that is projected. However, a symbol can also be animated and thus have motions, either by means of displacements in a direction of motion or by means of motions in three-dimensional space. A symbol can also be an entire video or film sequence that is projected using the second portion of the light. A symbol can also be a static or animated hologram which is projected into the access region, for example.

All surfaces which are part of the passenger transport system and can be reached by the second portion of the light can be used as a projection surface, such as surfaces of the balustrade, the balustrade base or the transport belt, the handrail, the access region, or the like. Of course, it is also possible to use surfaces of the building that are in the immediate vicinity of the passenger transport system as projection surfaces. In the special case of holograms, the space enclosing the passenger transport system can also be used as a projection surface. For reasons of clarity, the term projection surface is also used in this case, even if strictly speaking it is a three-dimensional projection space.

In order to be able to illuminate the transition surface in the manner mentioned, the illuminating device should be configured in such a way that the light it emits is not emitted uniformly in all directions or over a very large angular range. Instead, the illuminating device should emit the emitted light in a focused manner.

The light should be focused in such a way that, unlike spatially homogeneous light emission, an incident light intensity in a focus region is higher than in the case of spatially homogeneous light emission, but, outside the focus region, the incident light intensity is lower than in the case of spatially homogeneous light emission. In other words, the focused light emission of the light source should be configured in such a way that at least a first portion of the light emitted by the illuminating device is predominantly, e.g., more than 50%, preferably more than 80% or more than 90% or even more than 95%, directed toward the transition surface. At best, the entire light of at least the first portion of the light emitted by the illuminating device should illuminate the mentioned transition surface almost exclusively, e.g., for example, more than 98%. At most, a subordinate portion of the emitted light should illuminate regions outside the transition surface. This subordinate portion can result, for example, from focusing that cannot be ideally achieved from a technical point of view and/or due to light scattering.

Accordingly, surface regions adjoining the transition surface mentioned should substantially not be illuminated by the illuminating device. In other words, the transition surface should be illuminated with a high light intensity, whereas adjoining surface regions should not be illuminated by the illuminating device, or at most be illuminated by a significantly lower light intensity.

For example, the light intensity directed onto the transition surface can be more than twice as high, preferably more than five times as high or even more than ten times as high as the light intensity emitted by the illuminating device on surfaces directly laterally adjoining the transition surface. A difference in brightness between the illuminated transition surface and the surfaces adjoining it should thus be striking and clearly perceptible to the passenger.

In this context, it should be noted that, although the illuminating device can provide a second portion of emitted light, as explained in more detail below, the illuminating device is specifically configured to direct this second portion of the light into completely different regions to the transition region or the direct transition surface, e.g., not into partial regions directly adjoining the transition surface.

The described configuration of the illuminating device and the type of illumination of the transition surface that it produces make it possible to ensure that the transition between the stationary access region and the transport belt is not just illuminated in an unspecific manner. Instead, the illuminating device focuses at least the first portion of the light thereof specifically onto the transition surface covering this transition and, in this way, marks this transition in a way that the passenger can clearly perceive it visually.

Due to the fact that the transition region where the transport belt runs out near the entrance end of the passenger transport system, for example, under a comb plate of the stationary access region, or disappears near the exit end under the comb plate is marked by the light focused by the illuminating device, this transition region appears significantly brighter to the passenger than surrounding regions, directing the passenger's attention to this transition region.

The illuminating device of the passenger transport system can have one or preferably a plurality of light sources. Each light source can itself be configured in such a way that it does not emit light in a spatially uniform manner, but the light is emitted at least partially focused in a preferred direction or at least in a narrow angular range around a preferred direction.

Alternatively or additionally, each light source can be provided with optics, with the aid of which the light emitted by the light source can be focused. The optics can have, for example, focusing mirrors, lenses, or similar optical components.

The illuminating device can preferably be configured in such a way that the elongate transition surface illuminated thereby is substantially rectangular.

In other words, the transition surface illuminated by the illuminating device can have two edges that are substantially parallel to one another. Substantially parallel to one another can also comprise slight deviations from perfect parallelism, for example, the two edges can extend at angles between −10° and +10°, preferably at angles between −5° and +5°, to one another.

In order to illuminate such a rectangular transition surface, the illuminating device can be configured, for example, to emit a directed light beam toward the transition surface, which light beam illuminates or touches the transition surface at an oblique angle. In other words, the light source of the illuminating device can be arranged, for example, laterally next to and vertically above the transition region and direct its light obliquely downward as a directed light beam onto the transition region comprising the transition surface.

In this case, the transition surface can have a length dimension and a width dimension. The length dimension extends along the entire exposed width of the transport belt, whereas the width dimension extends perpendicularly to the length dimension and thus in parallel with the longitudinal direction of the passenger transport system and therefore also in parallel with the direction of motion of the transport belt. The transition surface should preferably have an elongate geometry in which the width dimension is less than 20%, preferably less than 10%, and more preferably even less than 5%, of the length dimension.

In other words, the transition surface should be designed as a relatively narrow stripe. This stripe should extend transversely to the longitudinal direction of the passenger transport system and thereby illuminate the transition region between the stationary access region and the moving transport belt in a focused manner and thus illuminate it locally and therefore mark it so as to make it recognizable for the passenger.

The width dimension of the transition surface can be, for example, less than 20 cm, preferably less than 10 cm, or even less than 5 cm. Compared to the entire length of the passenger transport system or its stationary access region or its transport belt, the transition surface brightly illuminated by the illuminating device due to this focusing is thus very narrow, which can in particular attract the attention of the passenger.

In particular, the illuminating device can be configured in such a way that the first portion of the light emitted by the at least one light source is focused in such a way that the elongate transition surface is illuminated with a homogeneity of more than 50%, preferably more than 80%, or even more than 90%.

In other words, the illumination of the transition surface caused by the illuminating device should be as homogeneous as possible, so that a passenger perceives this transition surface as an evenly bright and thus evenly marked surface. In particular, the light intensity with which partial regions of the transition surface are illuminated by the illuminating device should vary significantly less within the transition surface than when comparing the light intensity of the light impinging on the transition surface with the light intensity of the light, from the illuminating device, impinging outside the transition surface. The homogeneous illumination of the transition surface and the sharply separated difference in the light intensities inside and outside the transition surface increase the already described effect of the light emitted in a focused manner by the illuminating device as an optical marking of the transition region.

The illuminating device can preferably be configured to emit light selectively with different light spectra.

In other words, it can be advantageous, for example, to be able to control the one light source or the plurality of light sources of the illuminating device in such a way that the light spectrum of the light emitted by the illuminating device can be selectively altered overall. The light emitted by the illuminating device can thus, for example, selectively take on different colors or color mixtures. For example, the emitted light can be emitted as green light for specific purposes and as red light or blue light or generally any other colored light for other purposes. The color of the currently emitted light can be used to convey or suggest specific information to passengers. For example, by illuminating the transition surface with green light, it can symbolize that passengers can step onto the transport belt at this point, whereas illuminating the transition surface with red light can symbolize that the transport belt is moving at this point in the opposite direction to that desired by the passengers and should thus not be entered.

For this purpose, the illuminating device can have, for example, a plurality of different light sources which can be activated in a controlled manner independently of one another and which emit different light spectra from one another. Alternatively or additionally, the illuminating device can have filters, for example, through which the light emitted by one or more light sources is radiated, as a result of which the light passing through is varied with regard to its light spectrum depending on the optical properties of the filter. In this case, for example, a single filter can be provided in a beam path of the illuminating device, and the filter can change the optical properties thereof in a controlled manner. As an alternative or in addition, various filters can be provided for the illuminating device, which can be introduced into the beam path of the illuminating device in a controllable manner as required.

The at least one light source of the illuminating device can preferably be a light-emitting diode, e.g., an LED.

LEDs can generate light with a very high efficiency and can thus be operated in an energy-saving manner. In addition, an LED can require very little installation space so that it can, for example, be accommodated on or in other components of the passenger transport system in a space-saving manner. Furthermore, LEDs can have a very long service life so that, even with permanent operation and in view of a long service life of the passenger transport system, hardly any maintenance or repairs of the illuminating device should be necessary.

The illuminating device can have a plurality of LEDs, for example, which differ in terms of their emission spectra. Depending on which light spectrum or which color is intended to illuminate the transition surface, one or more different LEDs of the illuminating device can thus be activated. Alternatively or additionally, one or more tunable LEDs can be used in the illuminating device, e.g., LEDs that emit a different light spectrum depending on the control.

The illuminating device can be arranged, for example, in a balustrade or a base of a balustrade, laterally next to the transition region.

Typically, in passenger transport systems, the access regions at the ends and the transport belt between these access regions are laterally delimited by a balustrade. This balustrade can, for example, prevent passengers from accidentally moving sideways out of the passenger transport system. For example, a handrail that moves synchronously with the transport belt can be provided on the balustrade. The illuminating device can preferably be accommodated in such a balustrade or the base thereof in a space-saving manner. As a result, the illuminating device can be located laterally next to the transition region to be marked. In particular, the illuminating device can be arranged there on the balustrade or the base, so that the stationary access region is adjacent to the transport belt. The light emitted by the illuminating device can thus be directed, for example, across the transition region and thus illuminate the elongate transition surface covering this transition region in a locally focused manner and as homogeneously as possible and in this way optically mark it.

As already described above, the illuminating device also has a projection device. The projection device should be configured in such a way that different symbols can be displayed depending on the control of the projection device.

The symbols can be, for example, letters, numbers, pictograms, or simple geometric figures such as a rectangle, a circle, a triangle, or an arrow.

With the aid of the projection device, symbols which can be selected according to the situation can thus be projected onto the projection surface. These symbols can convey information to passengers of the passenger transport system. For example, the symbols can indicate the direction in which the transport belt of a passenger transport system is currently moving or whether an access region is an entrance or an exit of the passenger transport system, etc. Information can also be displayed about how the passenger transport system is to be used (e.g., "stand to the right, walk on the left," "hold on to the handrail," etc.) and/or which behaviors are prohibited on the passenger transport system (e.g., "no entry with roller skates").

In principle, however, a symbol can have the most diverse forms. As previously mentioned, a symbol can be a simple line, surface, or contour that is projected. However, a symbol can also be animated and thus have motions, either by means of displacements in a direction of motion or by means of motions in three-dimensional space. A symbol can also be an entire video or film sequence that is projected using the second portion of the light. A symbol can also be a static or animated hologram which is projected into the access region, for example.

The projection surface onto which the projection device projects desired symbols is typically arranged at different positions to the transition surface between the stationary access region and the moving transport belt. In principle, the projection surface can also be a surface running horizontally such as a part of the floor of the passenger transport system formed in the access region or the transport belt. However, the projection surface can also be another surface running transversely to the horizontal and in particular, for example, a surface running vertically. In principle, all surfaces which are part of the passenger transport system and can be reached by the second portion of the light from the projection device can be used as a projection surface. These include, for example, surfaces of the balustrade, the balustrade base or the transport belt, the handrail, the access region, or the like. Of course, it is also possible to use surfaces of the building that are in the immediate vicinity of the passenger transport system as projection surfaces. In the special case of holograms, the space enclosing the passenger transport system can also be used as a projection surface.

If the projection surface is a partial region on a balustrade and/or on the floor of the stationary access region, the projection device can, for example, display symbols in a way that is easily perceptible to passengers, in particular at a height that catches the eye. Symbols can be displayed by the projection device on the floor of the stationary access region, for example, which passengers should perceive before they enter the transport belt located behind it at the entrance to the passenger transport system or before they leave the transport belt at the exit of the passenger transport system.

The projection device can have a plurality of masks which can be selectively arranged between the at least one light source of the illuminating device and the projection surface. In this case, each of the masks can be configured to project light passing through as one or more symbols selected from the plurality of possible symbols onto the projection surface.

In other words, the projection device can have a plurality of different masks that are configured like shadow masks. In such shadow masks, regions that reproduce a symbol to be displayed are configured to be partially or completely transparent, whereas adjoining regions are configured to be partially or completely light-absorbing. Light directed onto the mask is thus transmitted in the transparent regions, whereas it is not transmitted in the light-absorbing regions or is at least transmitted in a different way, e.g., for example, with a different color. Depending on which symbol or symbols are currently to be projected, another of the available masks can be placed in the beam path between the light source and the projection surface in the projection device. For this purpose, the projection device can have a suitable mechanism and/or suitable actuators. The projection device can have a suitable controller for controlling such a mechanism or such an actuator system. The controller can, for example, control which of the available masks is currently to be used and/or at which point within the illuminating device or at which point in the beam path this mask is to be positioned.

Alternatively or additionally, the projection device can have a variable mask which is arranged between the at least one light source and the projection surface. The variable mask can be configured to variably project light passing through as one or more symbols selected from the plurality of possible symbols onto the projection surface.

In other words, the projection device can have a mask, the optical transmission behavior of which can be specifically varied as a function of the location. In this case, partial regions of a transmission surface which is arranged in the beam path between the light source and the projection surface can be changed in their optical transmission behavior by physical measures such as applying an electrical voltage. Depending on how the transmission behavior is set in the various partial regions of the transmission surface, incident light can be transmitted or absorbed completely or partially in order to thereby project desired symbols onto the projection surface.

The variable mask can be configured, for example, as an LCD mask (Liquid Crystal Display) in which a large number of pixels are provided on a transmission surface, and the optical transmission behavior of the liquid crystals contained therein can be influenced by applying an electrical voltage to each of the pixels. The projection device can have a suitable controller for controlling the variable mask. In this case, transparent-colored masks and also black/white masks can be generated with the LCD mask.

The projection device may further include a displacement mechanism which may be configured to displace the projection surface.

In other words, the projection device does not have to be static, so that it always projects the symbol to be displayed onto the same projection surface. Instead, it can have the displacement mechanism, with the aid of which the projection surface can be displaced, e.g., the symbol to be displayed can be projected onto different surfaces. The symbol to be displayed can of course also be animated in itself, e.g., displaying image sequences like in a film, for example, programmed in the controller.

The displacement mechanism can have optical components, for example, with the aid of which the image generated in the projection device can be deflected in different directions. For example, the displacement mechanism can have mirrors, lenses, or other optical components which are mechanically displaceable or the optical properties of which can be varied in some other way. The projection device can have a suitable controller for controlling the displacement mechanism.

Furthermore, the projection device can have a focusing device which is configured to selectively project the at least one symbol to be displayed onto projection surfaces that are spaced apart at different distances.

The focusing device can be used in this case, for example, in order to be able to display the symbols projected onto different projection surfaces by the projection device with the aid of the displacement mechanism in a focused and thus sharp manner. Similar to the displacement mechanism, the focusing device can also comprise optical components, with the aid of which the image generated in the projection device can be focused onto projection planes located at different distances. In this case, too, mirrors, lenses, or the like can be used as optical components. The projection device can in turn have a suitable controller for controlling the focusing device.

It should be noted that some of the possible features and advantages of the disclosure are described herein with reference to different embodiments. A person skilled in the art will recognize that the features can be suitably combined, adapted, or replaced in order to arrive at further embodiments of the disclosure.

BRIEF DESCRIPTION OF THE DRAWINGS

Embodiments of the disclosure will be described below with reference to the accompanying drawings; neither the drawings nor the description should be interpreted as limiting the disclosure.

15

The drawings are merely schematic and not true to scale. Like reference signs denote like or equivalent features in the various drawings.

DETAILED DESCRIPTION

Figure 1:
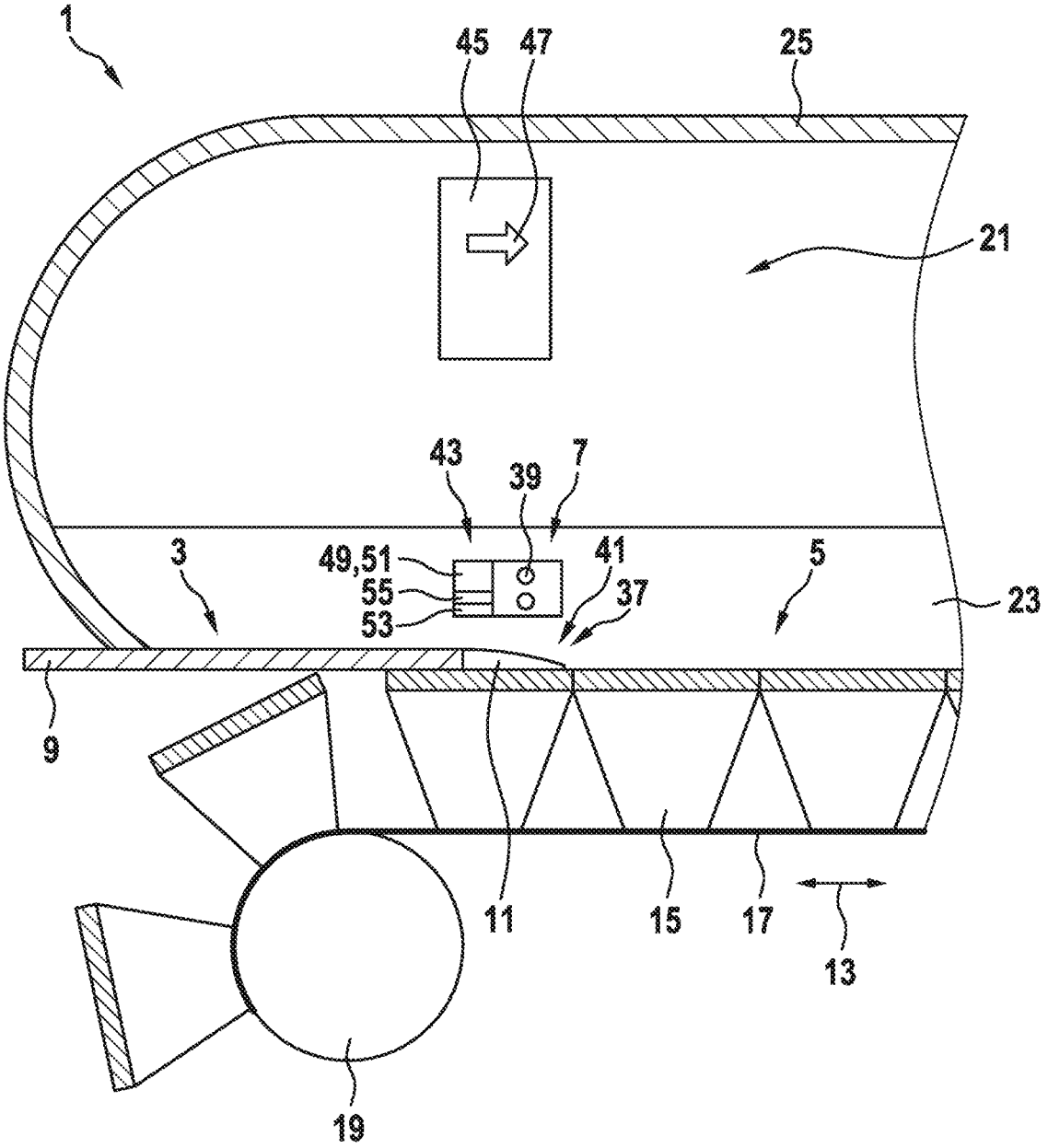
FIG. 1 is a longitudinal sectional view through partial regions of a passenger transport system according to an embodiment of the present disclosure.
Figure 2:
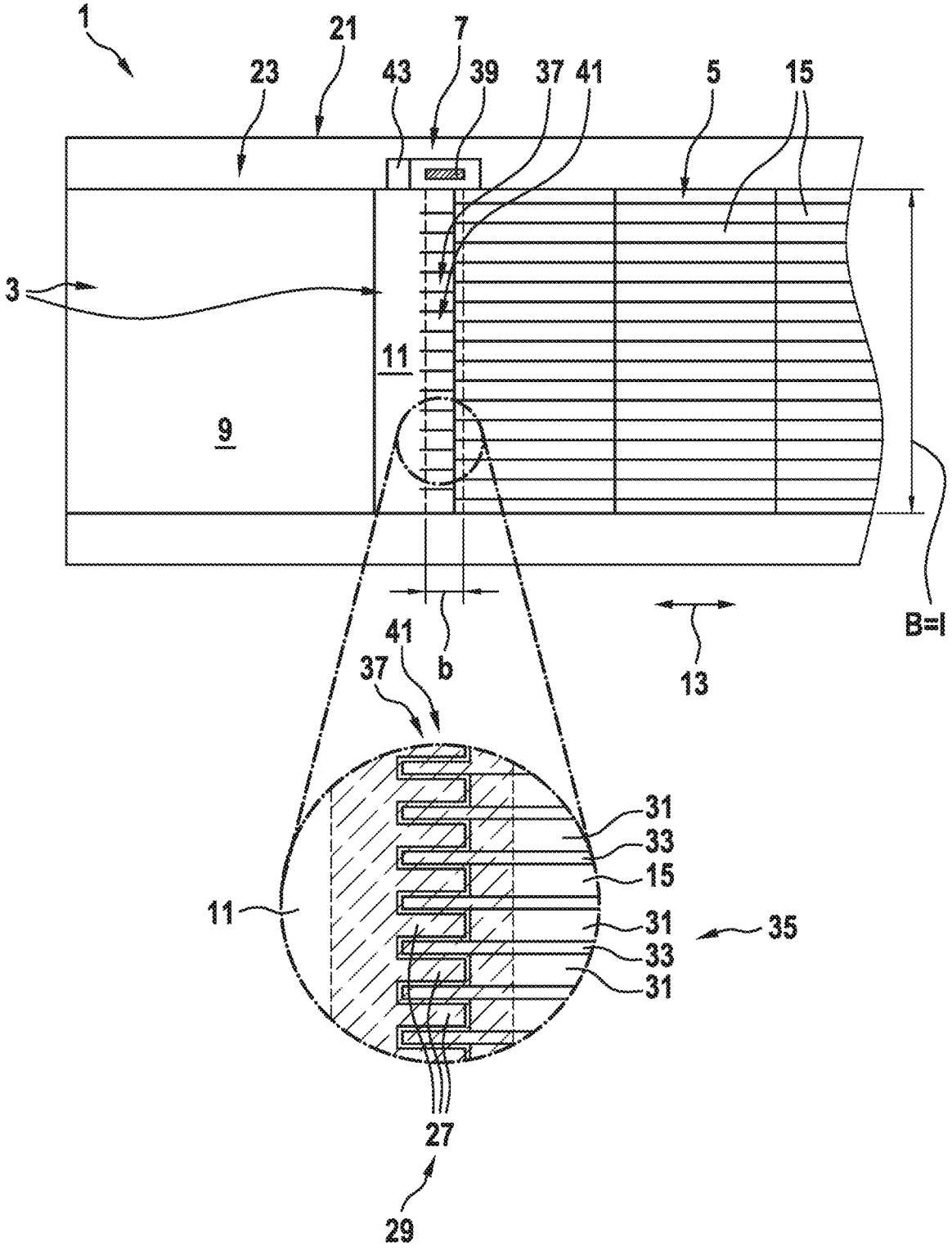
FIG. 2 is a top view and an enlarged detailed view of partial regions of a passenger transport system according to an embodiment of the present disclosure.

FIG. 1 and FIG. 2 show, in a longitudinal sectional view and in a top view, partial regions of a passenger transport system 1, on the basis of which features and properties of a passenger transport system 1 designed according to the disclosure can be explained. The figures only show a partial region near an entrance or exit of the passenger transport system 1. Components of the passenger transport system 1 are shown only schematically, and components that do not appear necessary for an understanding of the embodiment of the passenger transport system 1 according to the disclosure are partially not shown for reasons of clarity. The passenger transport system 1 can be designed as an escalator or moving walkway.

The passenger transport system 1 comprises a stationary access region 3, a transport belt and an illuminating device 7. The stationary access region 3 comprises components such as a floor plate 9 and a comb plate 11, which are fixedly connected to a building. The transport belt 5 has a plurality of tread units 15 arranged one behind the other along a direction of motion 13. In the event that the passenger transport system 1 is an escalator, these tread units 15 are designed as steps, whereas in the case of a moving walkway these tread units 15 are designed as pallets. The tread units 15 are coupled to one another via a conveyor such as a chain 17 and can be deflected on a deflection wheel 19. The entire transport belt 5 can be displaced in a circumferential manner and moves relative to the access region 3. The passenger transport system 1 also comprises two balustrades 21, each with a balustrade base 23 and a handrail 25 running along the balustrade 21.

As shown in the enlarged detail view in FIG. 2, the comb plate 11 has a plurality of teeth 27 which together form a static comb structure 29 of the access region 3. Grooves 31 and projections 33 projecting beyond these grooves 31 are formed on the upwardly directed surface of each of the tread units 15 and together form a combing structure 35 of the transport belt 5. A region in which the combing structure 35 adjoins the static comb structures 29, seen in the direction of motion 13, is referred to herein as the transition region 37.

The illuminating device 7 is arranged in the balustrade base 23 and comprises at least one light source 39. This light source 39 emits light in the visible spectrum. Due to a special configuration of the light source 39 used therein and/or due to optics (not shown) specially configured for this purpose, the illuminating device 7 is configured such that at least a first portion of the light emitted by the light source 39 is directed and focused in such a way that it illuminates predominantly an elongate transition surface 41. This transition surface 41 extends along the transition region 37 and covers it, including the static comb structures 29 provided therein and the combing structure 35 adjoining them.

The transition surface 41 extends transversely to the direction of longitudinal extension of the passenger transport system 1 along an entire exposed width B of the transport belt 5. The exposed width B of the transport belt 5 thus substantially corresponds to the length 1 of the transition surface 41. The transition surface 41 should have an elongate geometry in which a width b is substantially smaller than the length 1 of the transition surface 41, e.g., less than 10% of this length 1, for example. For example, the width b is less than 10 cm. Preferably, the transition surface 41 has a substantially rectangular geometry.

The illuminating device 7 is preferably configured in such a way that the first portion of the light it emits is focused on the transition surface 41 so that at least 80% of this light illuminates this transition surface 41. The illuminating device 7 is also configured to illuminate the transition surface 41 as homogeneously as possible.

The illuminating device 7 also has a projection device 43. This projection device 43 is configured to project a second portion of the light emitted by the light source 39 onto a projection surface 45. In this case, the projection surface 45 can, for example, be part of a balustrade 21 lying opposite the illuminating device 7.

The light should be projected in such a way that at least one symbol 47 from a plurality of possible symbols 47 is displayed on the projection surface 45. For this purpose, the projection device 43 can have one or more masks 49, 51 which are arranged between the light source 39 and the projection surface 45 and suitably transmit or absorb light passing through in order to be able to display the symbol 47. If necessary, a variable mask 51 can be configured with the aid of an LCD unit, for example. A symbol 47 can therefore have the most varied forms. For example, a symbol 47 can be a simple line, surface, or contour that is projected. However, a symbol 47 can also be animated and thus have motions, either by means of displacements in a direction of motion or by means of motions in three-dimensional space. A symbol 47 can also be an entire video or film sequence that is projected using the second portion of the light. A symbol 47 can also be a static or animated hologram which is projected into the access region 3, for example.

The projection device 43 can also have a displacement mechanism 53 with the aid of which the projection surface 45 can be displaced. For example, the displacement mechanism 53 can comprise suitable controllable optics in order to project the symbol to be displayed in a different direction and thus onto a projection surface 45 positioned differently. Furthermore, a focusing device 55 can be provided, with the aid of which the projection device 43 can selectively project the symbol 47 to be displayed in a focused manner onto projection surfaces 45 that are spaced apart at different distances. In the figures, the masks 49, 51, the displacement mechanism 53, and the focusing device 55 are only shown extremely schematically.

Figure 3:
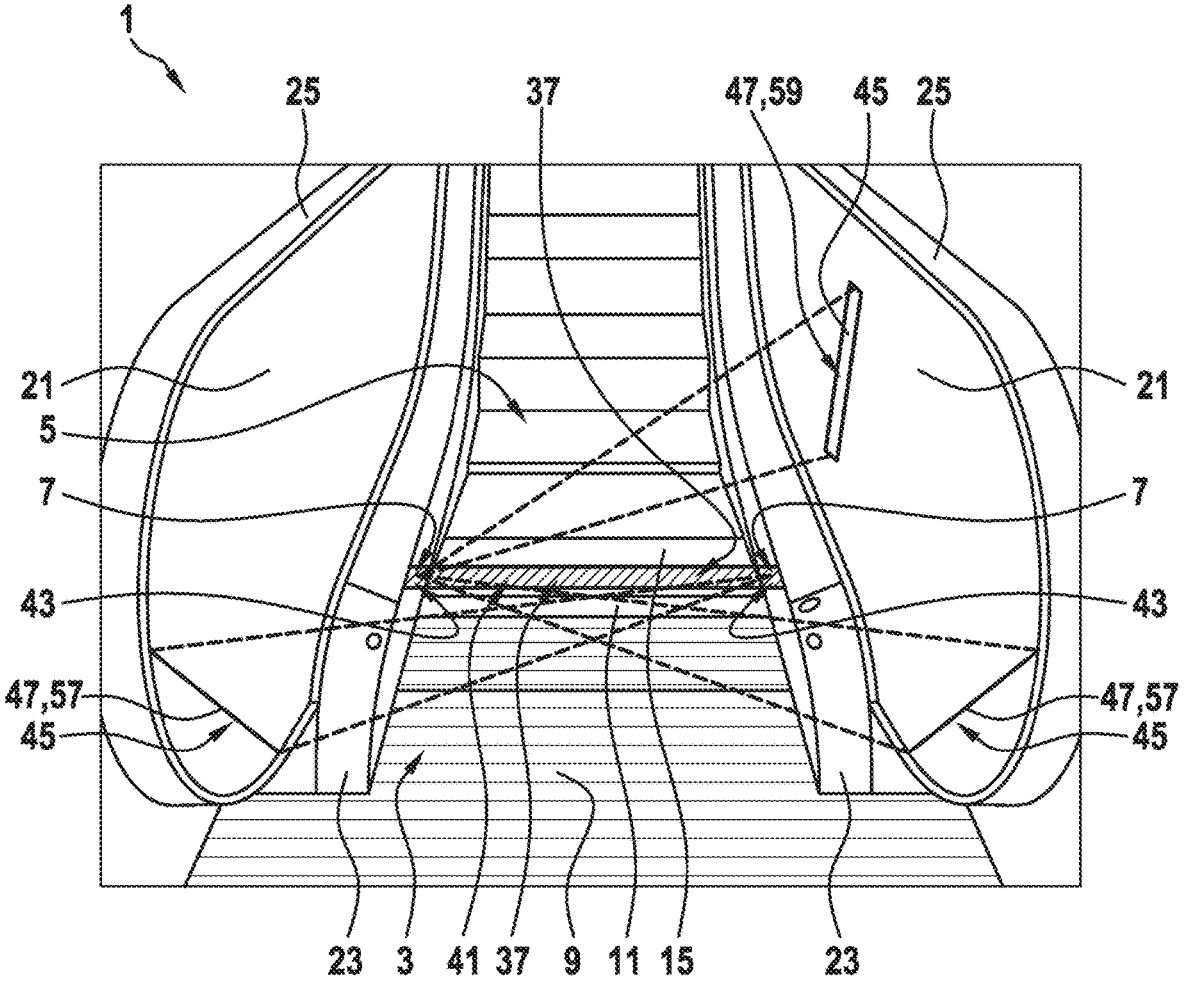
FIG. 3 is a perspective view of an entrance to a passenger transport system according to an embodiment of the present disclosure.

FIG. 3 shows an entrance to a passenger transport system 1 in the form of an escalator. To use the escalator, a passenger first crosses the stationary access region 3 having the floor plate 9 and the comb plate 11. The illuminating device 7 produces a bright stripe at the transition between the access region 3 and the transport belt 5 running behind it, in that the transition region 37 is illuminated in a focused manner along the elongate transition surface 41. This light stripe attracts the passenger's attention, so that he recognizes the transition from the stationary access region 3 to the moving transport belt 5 and can step onto the transport belt 5 with appropriate attention.

In addition, further information can be made available to the passenger with the aid of the projection device 43. For example, symbols 47 in the form of projected pictograms 59 can be displayed on a projection surface 45 on a surface of a balustrade 21 opposite the illuminating device 7. Alternatively or in addition, symbols 47 can be displayed in the form of projected lines 57 which can guide the passenger and/or which, for example, based on the color used for the lines, can indicate whether the passenger is located at the entrance or exit of the escalator.

For example, green lines can symbolize that access is possible since it is the entrance to the escalator, whereas red lines symbolize that it is an exit of the escalator and the escalator should thus not be entered at this access region 3. The transition surface 41 can also be illuminated in a corresponding color.

As shown in FIG. 3, the lines 57 can be projected onto the balustrades 21 on both sides of the transport belt 5. These second portions of the light emitted from two sides of the illuminating device 7 also allow holographic representations in the space between the balustrades 21 of the access region 3.

Finally, it should be noted that terms such as "comprising," "having," etc., do not preclude other elements or steps and terms such as "a" or "an" do not preclude a plurality. Furthermore, it should be noted that features or steps which have been described with reference to one of the above embodiments may also be used in combination with other features or steps of other embodiments described above. Reference signs in the claims should not be considered limiting.

The invention claimed is:

1. A passenger transport system configured as an escalator or a moving walkway, the passenger transport system comprising:

a stationary access region;

a transport belt comprising a plurality of tread units arranged along a direction of motion, the transport belt configured to be displaced in a circumferential manner relative to the stationary access region;

a transition region in which combing structures of the transport belt adjoin static comb structures of the access region;

an illuminating device having at least one light source for emitting light in the visible spectrum, wherein the illuminating device is configured such that at least a first portion of the light emitted by the at least one light source is focused such that it predominantly illuminates an elongate transition surface which includes the transition region including the comb structures and the combing structures of the transport belt which mesh therewith in the region of the comb structures, wherein the transition surface extends transversely to a direction of longitudinal extension of the passenger transport system along an entire exposed width of the transport belt, and wherein the illuminating device further comprises a projection device, the projection configured to project a second portion of the light emitted by the at least one light source onto a projection surface such that at least one symbol selected from a plurality of possible symbols is selectively displayed.

2. The passenger transport system of claim 1, wherein the illuminating device is configured such that the first portion of the light emitted by the at least one light source illuminates at least 80% of the elongate transition surface by.

3. The passenger transport system of claim 1, wherein the elongate transition surface is substantially rectangular.

4. The passenger transport system of claim 1, wherein the elongate transition surface has a length dimension which extends along the entire exposed width of the transport belt and a width dimension which extends perpendicularly to the length dimension, wherein the width dimension is less than 20% of the length dimension.

5. The passenger transport system of claim 4, wherein the width dimension is less than 20 cm.

6. The passenger transport system of claim 1, wherein the illuminating device is configured such that the first portion of the light emitted by the at least one light source illuminates the elongate transition surface with a homogeneity of more than 50%.

7. The passenger transport system of claim 1, wherein the illuminating device is configured to emit light selectively with different light spectra.

8. The passenger transport system of claim 1, wherein the at least one light source is a light-emitting diode.

9. The passenger transport system of claim 1, wherein the illuminating device is arranged on a balustrade to the side next to the transition region.

10. The passenger transport system of claim 1, wherein the projection surface is a partial region on a balustrade.

11. The passenger transport system of claim 1, wherein the projection surface is a partial region on the transport belt.

12. The passenger transport system of claim 1, wherein the projection surface is a partial region on the stationary access region.

13. The passenger transport system of claim 1, wherein the projection device comprises a plurality of masks which are configured to be selectively arranged between the at least one light source and the projection surface, wherein each of the masks is configured to project light passing through as one or more symbols selected from the plurality of possible symbols onto the projection surface.

14. The passenger transport system of claim 1, wherein the projection device comprises a variable mask which is arranged between the at least one light source and the projection surface, wherein the variable mask is configured to variably project light passing through as one or more symbols selected from the plurality of possible symbols onto the projection surface.

15. The passenger transport system of claim 1, wherein the projection device has a displacement mechanism which is configured to displace the projection surface.

16. The passenger transport system of claim 1, wherein the projection device has a focusing device which is configured to selectively project the at least one symbol to be displayed onto projection surfaces that are spaced apart at different distances.

* * * * *